US006836981B2

(12) United States Patent
Yoshino et al.

(10) Patent No.: US 6,836,981 B2
(45) Date of Patent: Jan. 4, 2005

(54) HYDRAULIC CONTROL CIRCUIT FOR BOOM CYLINDER IN WORK MACHINE

(75) Inventors: Tetsuya Yoshino, Tokyo (JP); Yoshiyuki Shimada, Tokyo (JP)

(73) Assignee: Shin Caterpillar Mitsubishi Ltd., Tokyo (JP)

( * ) Notice: Subject to any disclaimer, the term of this patent is extended or adjusted under 35 U.S.C. 154(b) by 57 days.

(21) Appl. No.: 10/276,796

(22) PCT Filed: Dec. 14, 2001

(86) PCT No.: PCT/JP01/11005

§ 371 (c)(1),
(2), (4) Date: Nov. 19, 2002

(87) PCT Pub. No.: WO02/063107

PCT Pub. Date: Aug. 15, 2002

(65) Prior Publication Data

US 2003/0121184 A1 Jul. 3, 2003

(30) Foreign Application Priority Data

Feb. 6, 2001 (JP) ..... 2001-029562

(51) Int. Cl.[7] ..... E02F 3/04
(52) U.S. Cl. ..... 37/348; 37/414; 37/902
(58) Field of Search ..... 37/348, 902, 414, 37/466

(56) References Cited

U.S. PATENT DOCUMENTS 6,502,499 B2 * 1/2003 Sannomiya et al. ..... 91/436
2004/0031173 A1 * 2/2004 Yoshino et al.

FOREIGN PATENT DOCUMENTS

| | | | | |
|---|---|---|---|---|
| JP | 6-34443 Y2 | | 9/1994 | |
| JP | 9-132927 A | | 5/1997 | |
| JP | 09132927 | * | 5/1997 | |
| JP | 9-151489 A | | 6/1997 | |
| JP | 11-247236 A | | 9/1999 | |
| WO | WO9102125 A1 | * | 2/1991 | ..... 37/348 |

* cited by examiner

*Primary Examiner*—Meredith Petravick
(74) *Attorney, Agent, or Firm*—Oliff & Berridge, PLC

(57) ABSTRACT

A hydraulic control circuit for a boom cylinder in a work machine, which, when controlling supply and discharge of pressurized oil with respect to a boom cylinder, improves fuel efficiency, work efficiency in combined operations, and improves work efficiency and operationality in the work of difficult boom operations, such as debris raking-up work and bumping work, wherein the hydraulic control circuit of a boom cylinder is provided with a change valve to hold a first boom control valve at a neutral position, a communication line for causing a head side oil chamber and a rod side oil chamber to communicate with each other, an opening valve for opening and closing the corresponding communication line, and pilot operating check valve that is changed to an unidirectional state where, although an oil flow from the head side oil chamber to the rod side oil chamber is permitted, a reverse flow is hindered, and to a bi-directional state where oil flows in both directions, and further a second boom control valve is provided with discharge means for causing oil discharged from the head side oil chamber to flow into an oil reservoir.

12 Claims, 3 Drawing Sheets

HYDRAULIC CONTROL CIRCUIT FOR BOOM CYLINDER IN WORK MACHINE

BACKGROUND OF THE INVENTION

1. Field of Invention

The invention relates to a hydraulic control circuit for a boom cylinder in work machine, such as a hydraulic excavator, that is used in various types of construction and civil engineering works.

2. Description of Related Art

Generally, in some construction and civil engineering machinery, such as a hydraulic excavator, there is a type in which a front attachment mounted on the machinery body is composed of a boom whose base end portion is supported so as to swing upward and downward, an arm that is supported at the tip end portion of the boom so as to swing forward and backward, and a work attachment, such as a bucket attached to the tip end portion of the arm. In such a type, the above-described boom moves upward and downward in line with extension and contraction of a boom cylinder, wherein, conventionally, a hydraulic control circuit, as shown in FIG. 3, has been known as a hydraulic control circuit for the boom cylinder.

That is, in FIG. 3, reference number 8 denotes a boom cylinder. Reference numbers 11, 12 denote the first and second pressurized oil supply sources. Reference number 13 denotes an oil reservoir. Reference number 14 denotes the first boom control valve for controlling the supply of pressurized oil to the boom cylinder 8 and discharge of pressurized oil therefrom, in which the first pressurized oil supply source is used as its pressurized oil supply source 11. Reference number 15 denotes the second boom control valve for controlling the supply of pressurized oil to the boom cylinder 8, in which the second pressurized oil supply source 12 is used as its pressurized oil supply source. Reference numbers 16 through 18 denote control valves for other hydraulic actuators, such as an arm cylinder and a bucket cylinder, attached to the hydraulic excavator. Reference number 19 denotes a pilot valve for outputting pilot pressure to the elevation side and descent side pilot lines C, D on the basis of operations of a boom operating lever 20. In addition, reference letter A denotes the head side line for connecting the first boom control valve 14 and the second boom control valve 15 respectively to the head side oil chamber 8*a* of the boom cylinder 8. Reference letter B denotes the rod side line for connecting the first boom control valve 14 to the rod side oil chamber 8*b* of the boom cylinder. Also, reference letter G denotes a recycling line for communicating the above-described head side line A and rod side line B with each other. In the recycling line G, a recycling valve 30 having a check valve 30*a* is provided.

In this structure, when the boom operating lever 20 is operated to the elevation side, the first and second boom control valves 14, 15 are changed to the elevation side position X by pilot pressure outputted from the pilot valve 19 to the elevation side pilot line C, wherein pressurized oil from both the first and second pressurized oil supply sources 11, 12 is supplied into the head side oil chamber 8*a* of the boom cylinder 8, and it is possible to efficiently carry out an upward motion (elevation) of the boom 5 against the weight of a front attachment.

On the other hand, when the boom operating lever 20 is operated to the descending side, the first boom control valve 14 is changed to the descending side position Y by pilot pressure outputted from the pilot valve 19 to the descending side pilot line D, and at the same time, the recycling valve 30 is changed to the second position Y where the recycling line G is opened, wherein, while the pressurized oil from the first pressurized oil supply source 11 is supplied into the rod side oil chamber 8*b* of the boom cylinder 8 via the first boom control valve 14, the oil discharged from the head side oil chamber 8*a* is discharged into the oil reservoir 13 via the first boom control valve 14 and, at the same time, is further supplied into the rod side oil chamber 8*b* via the recycling valve 30. That is, when the boom descends, while the pressure of the head side oil chamber 8*a* is higher than that of the rod side oil chamber 8*b*, the oil discharged from the head side oil chamber 8*a* may be supplied into the rod side oil chamber 8*b* as the recycling oil, wherein the recycling oil is supplied into the rod side oil chamber 8*b* in addition to the pressurized oil of the first pressurized oil supply source 11, which is supplied from the above-described first boom control valve 14, and accordingly the operation speed of the boom cylinder 8 can be made fast with the rod side oil chamber 8*b* not placed in a pressure-reduced state. Also, because a surplus pump oil flow obtained by recycling can be supplied into other hydraulic actuators when a combined operation including operation of the other hydraulic actuators (for example, an arm cylinder and a bucket cylinder), for which the pressurized oil supply source for the boom cylinder 8 is concurrently used, and descent of the boom is carried out, it is possible to prevent the operation speed of the other hydraulic actuators from being lowered in a combined operation. Therefore, the structure contributes to an improvement in the work efficiency.

However, where the above-described boom is caused to descend to carry out surface compaction work and scraping work of an inclined plane by descent of the boom, because a force against the descent of the boom operates, it is necessary to supply highly pressurized oil into the rod side oil chamber 8*b*. To the contrary, where the boom is caused to descend in the air (that is, where the boom descends with the front attachment not grounded), as the weight applied to the boom (that is, the total weight of the front attachment) operates as a force for contraction of the boom, pressurized oil that is supplied into the rod side oil chamber 8*b* may be of low pressure. Further, because the head side area of the piston of the boom cylinder is larger than the rod side area, only the recycling oil from the above-described head side oil chamber 8*a* may be sufficient.

Therefore, in the above-described prior art hydraulic circuit, even if the boom is caused to descend in the air, not only the recycling oil but also pressurized oil from the first pressurized oil supply source are supplied via the first boom control valve 14. Accordingly, where the arm and bucket are operated while causing the boom to descend in the air, the pressurized oil from the first pressurized oil supply source 11 is shared by the boom cylinder, arm cylinder and bucket cylinder, wherein motions of the arm and bucket become slow in comparison with independent operations thereof, and there is a problem in that work efficiency is worsened. Further, in the case of causing the boom to independently descend in the air, because pressurized oil from the first pressurized oil supply source is supplied into the rod side oil chamber 8*b* in spite of only the recycling oil from the head side oil chamber 8*a* being sufficient, a considerable amount of surplus oil of the oil discharged from the head side oil chamber 8*a* is discharged into the oil reservoir 13 via the first boom control valve 14, wherein there is another problem in that energy loss is brought about, which may hinder improvement in fuel efficiency. These are objects to be solved by the invention.

In addition, in a work machine provided with a front attachment consisting of the above-described boom, arm and work attachment, etc., for example, wherein debris rake-up work is carried out with the bottom of the bucket grounded while moving the boom forward and backward, although three operations of the boom, arm and bucket are obliged to be carried out at the same time for the boom to depict a roughly horizontal locus, the operations are delicate, and skilled operations are required. In addition, where the ground is hardened by continuously repeated operations of descent and elevation of the boom, that is, bumping work is carried out, unless the boom elevation operation is carried out at the instant when the bucket bottom is grounded, the ground is excessively bumped by a reaction caused by the descent of the boom, or the front part of a machine body is raised. Therefore, in order to continuously carry out bumping, a considerably skilled operation is required. Work requiring such skill is difficult for a beginner, and even a skilled operator is obliged to pay meticulous attention to the work. Accordingly, another problem to be solved exists in that, in such situations, the operationality and work efficiency are made worse.

SUMMARY OF THE INVENTION

In view of the above-described situations, the invention was developed to solve these and other problems. It is therefore an object of the invention to provide a hydraulic control circuit for a boom cylinder, comprising a boom cylinder that causes the boom to extend and contract in order to move the boom upward and downward; a first control valve that is freely changed to an operation position that controls supply of pressurized oil to respective oil chambers at the head side and the rod side of the boom cylinder and discharge thereof on the basis of operations of an operating member with the first pressurized oil supply source used as a pressurized supply source and to a neutral position where no pressurized oil is supplied thereinto and discharged therefrom; and a second control valve that controls supply of pressurized oil to a weight-holding side oil chamber of the respective oil chambers of the boom cylinder, which holds the weight of the boom, with a second pressurized oil supply source used as another pressurized oil supply source, wherein the corresponding hydraulic control circuit is provided with neutral holding means capable of holding the first control valve in the neutral position regardless of any operation of the operating member and a communication line for causing the head side oil chamber and rod side oil chamber of the boom cylinder to communicate with each other, the corresponding communication line is provided with opening and closing valve means for opening and closing the communication line, and direction valve means that is freely changed to an unidirectional state where, while an oil flow from the weight-holding side oil chamber of the boom cylinder to the other oil chamber is permitted, a reverse oil flow is hindered, and to a bidirectional state where oil flows in both directions, and the above-described second control valve is provided with discharge means for flowing surplus oil of the oil, which is discharged from the weight-holding side oil chamber of the boom cylinder and supplied into the other oil chamber, into an oil reservoir when the first control valve is held in the neutral position by the neutral holding means.

With such a structure provided, by holding the first control valve in the neutral position in response to work content to be carried out by the boom and opening and closing the communication line in the unidirectional state and bi-directional state, the structure contributes to improvement in fuel efficiency, and at the same time, work efficiency can be improved in combination work with other hydraulic actuators for which the pressurized oil supply source of the boom cylinder is concurrently used, or work efficiency and operationality can be improved with respect to work, such as debris raking-up work or bumping work, for which boom operations are difficult. Furthermore, when the first control valve is held in the neutral position, oil discharge from the weight-holding side oil chamber to the oil reservoir is carried out by using the second control valve to supply pressurized oil of the second pressurized oil supply source into the weight-holding side oil chamber. Therefore, it is not necessary to separately provide an exclusive discharge valve and an exclusive discharge line, and this contributes to cost savings.

In such a structure, if the hydraulic control circuit is structured so that the neutral holding means operates so as to hold the first control valve in the neutral position, where pressure detecting means to detect the pressure of the other oil chamber is provided, and the pressure of the other oil chamber, which is detected by the pressure detecting means is lower than or equal to a predetermined pressure, the neutral holding means operates to hold the first control valve at the neutral position in the case where, for example, the boom moves downward in the air, in response to a downward motion of the boom, which is recognized by the pressure of the other oil chamber.

Further, the above-described neutral holding means comprises, for example, valve means capable of interrupting the pilot pressure outputted to change the first control valve to its operation position on the basis of operation of the operating member.

Also, the valve means comprising the above-described neutral holding means is structured, while output of pilot pressure is interrupted to the first control valve, so that the valve means for holding the first control valve in the neutral position outputs the corresponding pilot pressure to the second control valve and changes the second control valve to the operation state of the discharge means. Therefore, because it becomes possible for the second control valve to be changed to the operation state of the discharge means, concurrent use of members can be achieved, resulting in production cost savings.

Still further, where pressure detecting means for detecting the pressure of the other oil chamber is provided, and the pressure of the other oil chamber, which is detected by the corresponding pressure detecting means, exceeds the set pressure established in advance, if the direction valve means is set so that the unidirectional state cannot be changed to the bi-directional state. Thereby, for example, where the front part of the machine body is raised by a descending force of the boom, such an inconvenience, by which the communication line is improperly changed to the bi-directional state, can be prevented from occurring.

BRIEF DESCRIPTION OF THE DRAWINGS

The invention will be described in the reference to the drawings in which.

DETAILED DESCRIPTION OF PREFERRED EMBODIMENTS

Figure 1:
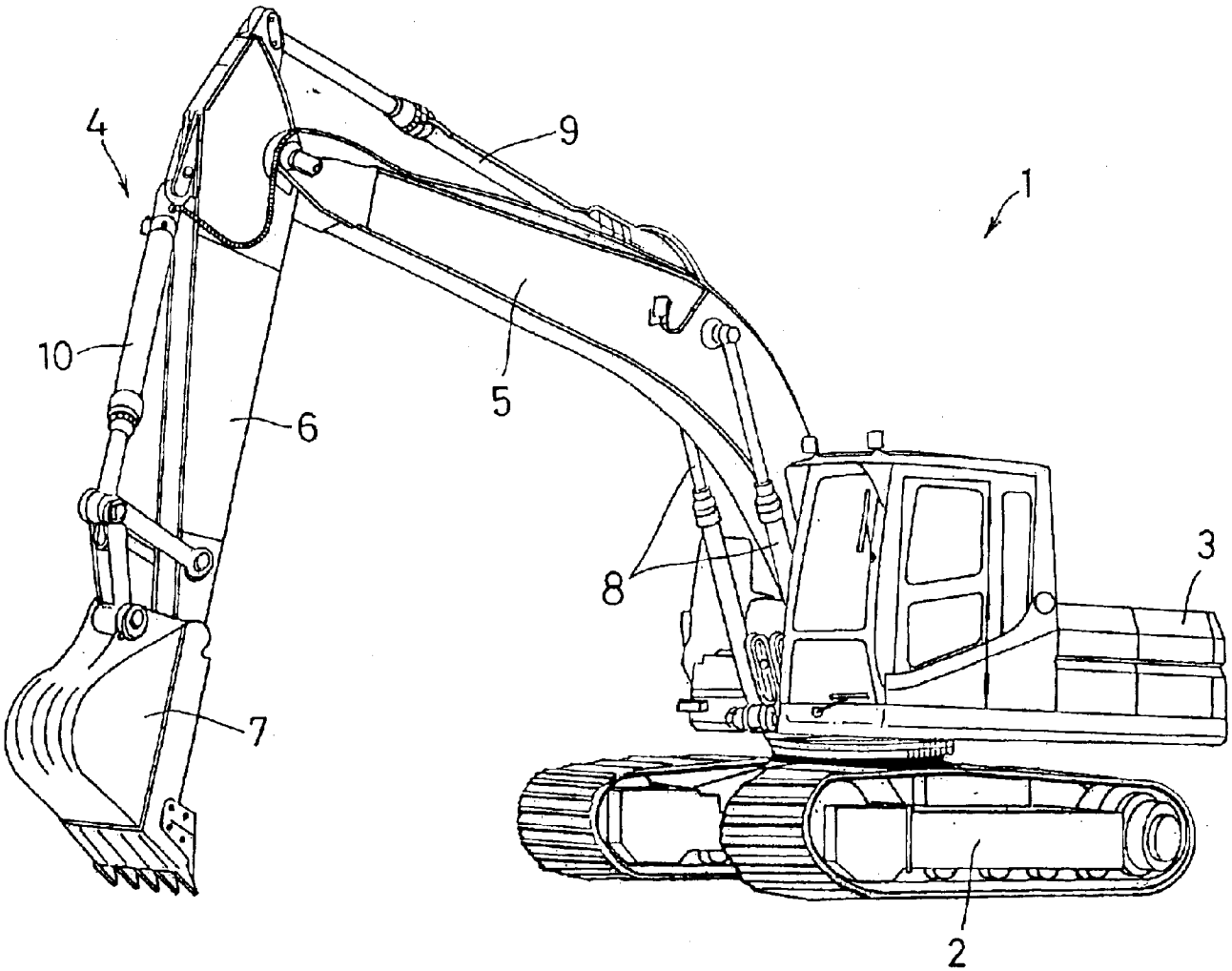
FIG. 1 is a perspective view of a hydraulic shovel.

In FIG. 1, reference number 1 denotes a hydraulic excavator. The hydraulic excavator 1 is composed of respective parts, such as a crawler type lower structure 2, an upper structure 3 that is supported on the lower structure 2 so as to freely turn, and a front attachment 4 mounted at the front side of the upper swiveling structure 3. Further, the front attachments 4 is composed of a boom 5 that is supported on the upper structure 3 swingably upward and downward, an arm 6 that is supported at the tip end of the boom 5 to be swingable forward and backward, a bucket 7 that is supported at the tip end part of the arm 6 to be swingable forward and backward, a boom cylinder 8, an arm cylinder 9 and a bucket cylinder 10, which respectively swing the boom 5, arm 6 and bucket 7. That is, the basic structure is the same as that of the related art hydraulic excavator.

Figure 2:
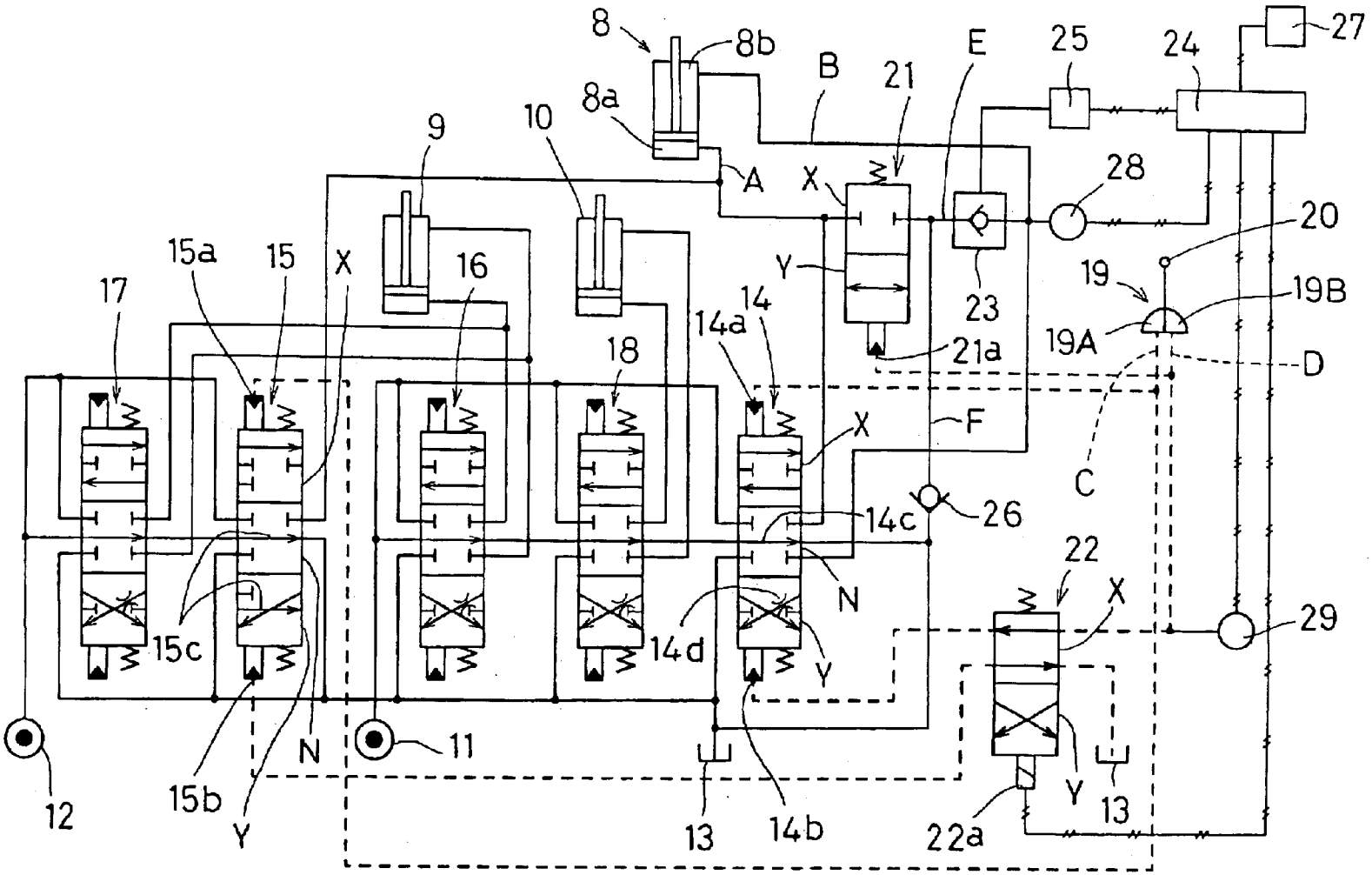
FIG. 2 is a hydraulic circuit diagram showing an embodiment of the invention.
Figure 3:
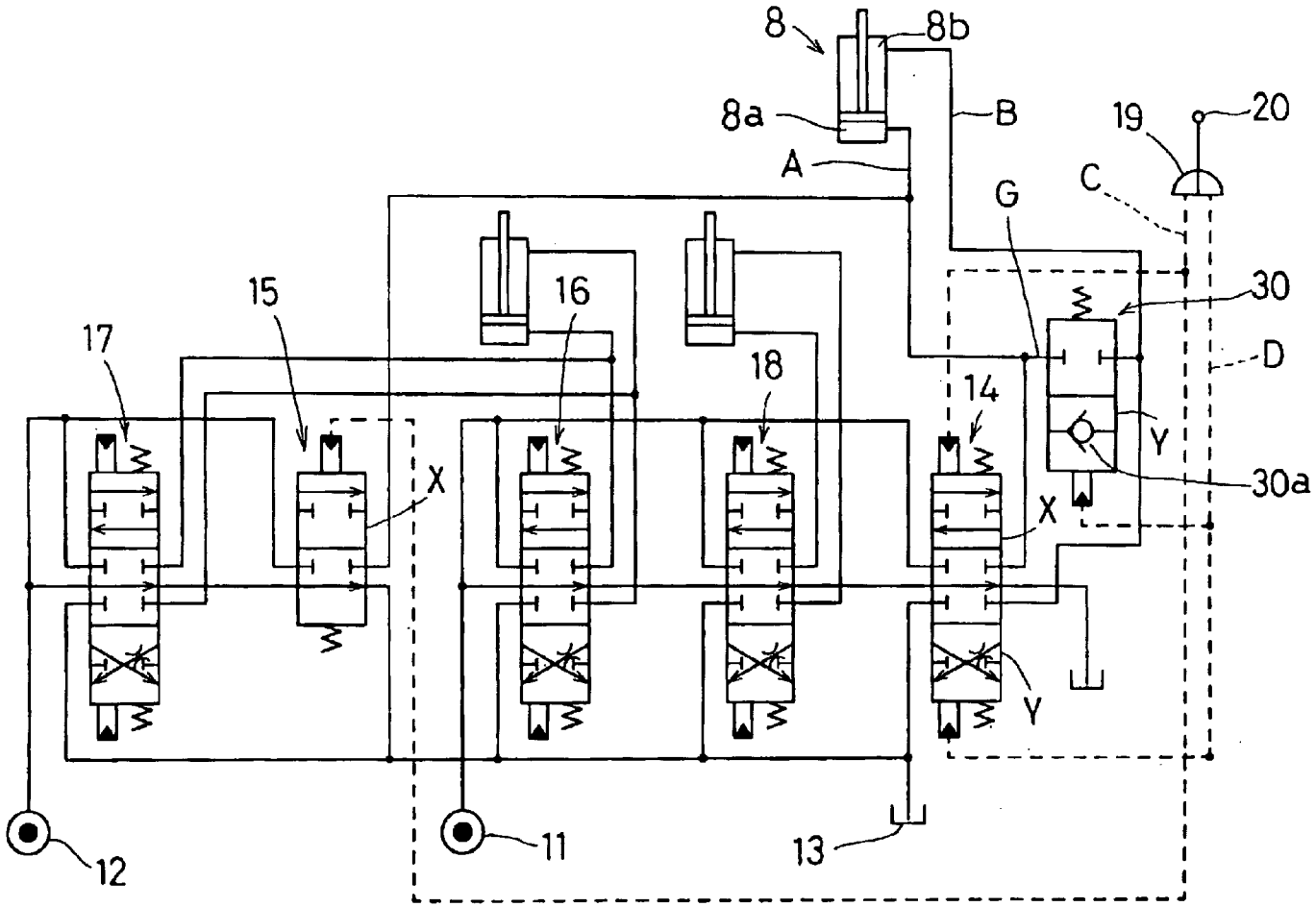
Fig. 3 RELATED ART
FIG. 3 is a hydraulic circuit diagram showing a related art example.

FIG. 2 shows a hydraulic control circuit for the above-described boom cylinder 8. In FIG. 2 reference numbers 11, 12 denote the first and second pressurized oil supply sources that are mounted in the hydraulic excavator 1. Reference number 13 denotes an oil reservoir. Reference numbers 14, 15 denote the first and second boom control valves. Reference numbers 16, 17 denote the first and second arm control valves. Reference number 18 denotes a bucket control valve. The first arm control valve 16, the bucket control valve 18 and the first boom control valve 14 are connected to each other in juxtaposition with the first pressurized oil supply source 11 used as their pressurized oil supply source. In addition, the second arm control valve 17 and the second boom control valve 15 are connected to each other in juxtaposition with the second pressurized oil supply source 12 used as their pressurized oil supply source. Herein, there are other control valves that are connected in juxtaposition with respect to the above-described control valves 14 through 18, corresponding to various types of hydraulic actuators provided in the hydraulic excavator 1. However, these control valves are omitted in FIG. 2. Further, in FIG. 2, reference letter A denotes a head side line that connects the first boom control valve 14 and the second boom control valve 15 to the head side oil chamber 8*a* of the boom cylinder 8, and reference letter B denotes a rod side line that connects the first boom control valve 14 to the rod side oil chamber 8*b* of the boom cylinder 8.

The above-described boom cylinder 8 extends by supply of pressurized oil into the head side oil chamber 8*a* and discharge thereof from the rod side oil chamber 8*b*, thereby elevating the boom 5. The same boom cylinder 8 contracts by supply of pressurized oil into the rod side oil chamber 8*b* and discharge thereof from the head side oil chamber 8*a*, thereby causing the boom 5 to descend. In this case, the head side oil chamber 8*a* holds the weight of the front attachment 4, and corresponds to the weight holding side oil chamber of the invention.

Also, the above-described first boom control valve 14 is a pilot-operating three-position change valve, which is provided with the elevation side and descent side pilot ports 14*a*, 14*b*. In a state where no pilot pressure is inputted into either pilot port 14*a*, 14*b*, the above-described first boom control valve 14 is located in the neutral position N where no pressurized oil is supplied and discharged with respect to the boom cylinder 8 while the same causes pressurized oil from the first pressurized oil supply source 11 to flow into the oil reservoir 13 via a center bypass valve line 14*c*. However, if pilot pressure is inputted into the elevation side pilot port 14*a*, pressurized oil from the first pressurized oil supply source 11 is supplied into the head side oil chamber 8*a* of the boom cylinder 8 via the head side line A, wherein the first boom control valve 14 is changed to the elevation side position X where oil discharged from the rod side oil chamber 8*b* is caused to flow into the oil reservoir 13 via the rod side line B. In addition, if pilot pressure is inputted into the descending side pilot port 14*b*, pressurized oil from the first pressurized oil supply source 11 is supplied into the rod side oil chamber 8*b* via the rod side line B, and the first boom control valve 14 is changed to the descending side position Y where oil discharged from the head side oil chamber 8*a* to the head side line A is caused to flow into the oil reservoir 13 via a restrictor 14*d*.

On the other hand, the above-described second boom control valve 15 is a pilot-operating three-position valve, which is provided with the elevation side and descending side pilot ports 15*a*, 15*b*, in a state where no pilot pressure is inputted into either pilot port 15*a*, 15*b*, the second boom control valve 15 is located in the neutral position N where, while pressurized oil from the second pressurized oil supply source 12 is caused to flow into the oil reservoir 13 via the center bypass valve line 15*c*, no pressurized oil is supplied and discharged with respect to the boom cylinder 8, and if pilot pressure is inputted into the elevation side pilot port 15*a*, the second boom control valve 15 is changed to the elevation side position X where pressurized oil from the second pressurized oil supply source 12 is supplied into the head side oil chamber 8*a* of the boom cylinder 8 via the head side line A. In addition, if pilot pressure is inputted into the descending side pilot port 15*b*, the second boom control valve 15 is changed to the descending side position Y where, while pressurized oil from the second pressurized oil supply source 12 is caused to flow into the oil reservoir 13 via the center bypass valve line 15*c*, oil discharged from the head side oil chamber 8*a* is caused to flow into the oil reservoir 13 via the head side line A.

Also, although a description of the first and second arm control valves 16, 17 and the bucket control valve 18 is omitted, pressurized oil of the first and second pressurized oil supply sources 11, 12 is supplied into the arm cylinder 9 via the first and second arm control valves 16, 17, and pressurized oil of the first pressurized oil supply source 11 is supplied into the bucket cylinder 10 via the bucket control valve 18.

Further, in FIG. 2 described above, reference number 19 denotes a pilot valve. The pilot valve 19 is composed of an elevation side pilot valve 19A and the descending side pilot valve 19B. The elevation side and descending side pilot valves 19A, 19B, respectively, output pilot pressure on the basis of the operation of the boom operating lever 20 to the elevation side and descending side. The pilot pressure outputted from the elevation side pilot valve 19A is inputted into the elevation side pilot ports 14*a*, 15*a* of the first and second boom control valves 14, 15 via the elevation side pilot line C. In addition, the pilot pressure outputted from the descending side pilot valve 19B is inputted into the pilot port 21*a* of an opening and closing valve 21, described later, via the descending side pilot line D, and at the same time, is supplied to a change valve 22 described later.

On the other hand, reference letter E denotes a communication line that causes the above-described head side line A and rod side line B to communicate with each other. The above-described opening and closing valve 21 and a pilot operating check valve 23 described later are disposed in the communication line E.

The above-described opening and closing valve 21 is a two-position change valve provided with the pilot port 21*a*. In a state where no pilot pressure is inputted into the pilot port 21*a*, the two-position change valve is located at the closing position X that closes the above-described communication line E. However, when pilot pressure is supplied into the pilot port 21*a*, the two-position change valve is changed to the opening position Y that opens the communication line E.

Also, the pilot operating check valve 23 is disposed in the communication line E from the above-described opening and closing valve 21 and connects with the rod side line B. The pilot operating check valve 23 that is placed in an unidirectional state is permitted where, although an oil flow from the head side line A to the rod side line B is permitted when no external signal is inputted, a reverse oil flow, that is, an oil flow from the rod side line B to the head side line A is interrupted, and when an external signal is inputted, the pilot operating check valve 23 is placed in a bi-directional state that permits oil flow in both directions.

Herein, in the present embodiment, a hydraulic signal is employed as the external signal that is inputted into the above-described pilot operating check valve 23. The hydraulic signal is outputted to the pilot operating check valve 23 via external signal outputting means 25 on the basis of commands from the controller 24 as described below. It is obvious an electric signal may be used as an external signal.

Further, reference letter F denotes a reservoir line that is bifurcated from the communication line E from the above-described opening and closing valve 21 to the rod side line B and reaches the oil reservoir 13. A make-up check valve 26 that permits an oil flow from the oil reservoir 13 to the communication line E, but interrupts an oil flow in the reverse direction, is disposed in the reservoir line F.

On the other hand, the above-described change valve 22 is an electromagnetic type two-position change valve that is provided with a solenoid 22*a*. In a state where the solenoid 22*a* is not magnetized, the change valve 22 inputs pressure of the descending side pilot line D into the descending side pilot port 14*b* of the first boom control valve 14, and is located at the first position X where the descending side pilot port 15*b* of the second boom control valve 15 is caused to communicate with the oil reservoir 13. However, in a state where the solenoid 22*a* is magnetized, the change valve 22 inputs pressure of the descending side pilot line D into the descending side pilot port 15*b* of the second boom control valve 15, and is located at the second position Y that causes the descending side pilot port 14*b* of the first boom control valve 14 to communicate with the oil reservoir 13. The change valve 22 is structured so that the solenoid 22*a* is magnetized on the basis of commands from the controller 24.

The controller 24 is structured by using a microcomputer, etc. Signals from an operation switch 27 (a push button switch may be acceptable, which is always turned off but can be turned on only while an operator is pressing the push button switch) that changes ON and OFF by the operation of an operator, a first pressure sensor 28 that detects the pressure of the rod side line B, and the second pressure sensor 29 that detects the pressure of the descending side pilot line D are inputted into the controller 24, and the controller 24 outputs commands to the above-described change valve 22 and external signal outputting means 25 on the basis of the input signals.

That is, where the pressure P of the rod side line B, which is detected by the first pressure sensor 28, is lower than or equal to a predetermined pressure Pd (that is $P \leqq d$), and the output of the pilot pressure from the descending side pilot valve 19B is detected by the second pressure sensor 29, the controller 24 outputs commands to magnetize the solenoid 22*a* to the change valve 22. On the other hand, where the pressure P of the rod side line B is greater than the predetermined pressure Pd (that is, $P>Pd$), or where no output of the pilot pressure from the descending side pilot valve 19B is detected, no command to magnetize the solenoid 22*a* is outputted to the change valve 22.

Herein, the above-described predetermined pressure Pd is set as the maximum pressure of the rod side line B when the boom 5 descends by its own weight in the air. Although the pressure P of the rod side line B is lower than or equal to the predetermined pressure Pd (that is, $P \leqq Pd$) when the boom 5 descends by its own weight in the air, the pressure P of the rod side line B becomes greater than the predetermined pressure Pd (that is, $P>Pd$) when the boom 5 descends in a state where a force against the descent of the boom 5 operates in such cases where the boom 5 descends due to a cause other than its own weight in the air, that is, where the boom 5 descends for surface compaction work or scraping work of an inclined plane.

Also, the controller 24 outputs commands of an external signal output to the external signal outputting means 25 when the operation switch 27 is turned on. On the other hand, when the operation switch 27 is turned off, no command of an external signal output is outputted. Further, where the operation switch 27 is changed from OFF to ON in a state where the pressure P of the rod side line B, which is detected by the first pressure sensor 28, is greater the above-described predetermined pressure Pd (that is, $P>Pd$), the controller 24 is set so that it does not output any command of an external signal output regardless of an ON signal from the operation switch 27.

In such a structure as described above, in a state where the boom operating lever 20 is not operated, that is, where no pilot pressure is outputted from the pilot valve 19, no pilot pressure is supplied to the first and second boom control valves 14, 15, and the opening and closing valve 21, and both the first and second boom control valves 14, 15 are located in the neutral position N where no pressurized oil is supplied to and discharged from the boom cylinder 8, and the opening and closing valve 21 is located at the closing position X that closes the communication line E. In this state, no pressurized oil is supplied to and discharged from the head side oil chamber 8*a* and rod side oil chamber 8*b* respectively, of the boom cylinder 8, wherein the boom 5 stops.

On the other hand, where the boom 5 is elevated, when the boom operating lever 20 is operated to the elevation side, the pilot pressure outputted from the elevation side pilot valve 19A is supplied into the elevation side pilot ports 14*a*, 15*a* of the first and second boom control valves 14, 15, wherein the first and second boom control valves 14, 15 are changed to the elevation side position X. Therefore, while pressurized oil from the first and second pressurized oil supply sources 11, 12 is supplied to the head side oil chamber 8*a* of the boom cylinder 8 via the first and second control valves 14, 15, oil discharged from the rod side oil chamber 8*b* is discharged into the oil reservoir 13 via the first boom control valve 14. Accordingly, the boom cylinder 8 extends to cause the boom 5 to be elevated. That is, when the boom 5 is elevated, pressurized oil from the first and second pressurized oil supply sources 11, 12 is supplied into the boom cylinder 8, and it becomes possible to efficiently carry out an elevation motion of the boom 5 against the weight of the front attachment 4.

Also, where the boom 5 is caused to descend, there are various cases where the boom is caused to descend in the air (that is, where the boom 5 is caused to descend in a state where the front attachment 4 is not grounded), where the boom 5 is caused to descend in a state where a force against the descent of the boom for surface compaction work and scraping work of an inclined plane by descending of the boom, and where debris rake-up work and bumping work are carried out while grounding the bottom of the bucket 7. In such cases, it is possible to carry out a descending motion of the boom 5 suitable for respective work on the basis of ON and OFF changeover of the above-described operation switch 27 and detection of the pressure of the rod side line B.

That is, where the boom 5 is caused to descend in the air and where the boom 5 is caused to descend in a state where a force against the descent of the boom for surface compaction work and scraping work of an inclined plane by the descent of the boom 5 operates, the operation switch 27 is turned off. With the operation switch 27 turned off, the controller 24 does not output any command, or an external signal output, to the external signal outputting means 25, wherein the pilot operating check valve 23 is placed into an unidirectional state where, although the same permits an oil flow from the head side line A to the rod side line B, a reverse oil flow, that is, from the rod side line B to the head side line A is interrupted.

In this state, when the boom operating lever 20 is shifted down to cause the boom 5 to descend in the air, output of the pilot pressure from the descending side pilot valve 19B is detected by the second pressure sensor 29 and, at the same time, because the pressure P of the rod-side line B, which is detected by the first pressure sensor 28, becomes lower than or equal to the predetermined pressure Pd (that is, $P \leqq d$), commands for magnetization of the solenoid 22*a* is outputted from the controller 24, and the change valve 22 is changed to the second position Y.

And, while, in a state where the above-described change valve 22 is located at the second position Y, the pilot pressure that is outputted from the descending side pilot valve 19B on the basis of operation of the boom operating lever 20 is supplied to the descending side pilot port 15*b* of the second boom control valve 15 via the change valve 22 located at the above-described second position Y, the pilot pressure is not supplied to the descending side pilot port 14*b* of the first boom control valve 14. Thereby, the first boom control valve 14 is held in the neutral position N, wherein no pressurized oil is supplied to and discharged from the boom cylinder 8. On the other hand, while the second boom control valve 15 is changed to the descending side position Y and causes the pressurized oil from the second pressurized oil supply source 12 to flow into the oil reservoir 13 via the center bypass valve line 15*c*, oil discharged from the head side oil chamber 8*a* is caused to flow into the oil reservoir 13 via the head side line A.

Further, the pilot pressure outputted from the descending side pilot valve 19B is also supplied into the pilot port 21*a* of the opening and closing valve 21 on the basis of operation of the above-described boom operating lever 20, wherein the opening and closing valve 21 is changed to the second position Y that opens the communication line E. In addition, as described above, the pilot operating check valve 23 is placed into a unidirectional state by commands from the controller 24.

Thereby, oil discharged from the head side oil chamber 8*a* of the boom cylinder 8 is supplied, as recycling oil, into the rod side oil chamber 8*b* via the head side line A, communication line E and rod side line B, and simultaneously, is discharged into the oil reservoir 13 via the second boom control valve 15 located at the descending side position Y. Accordingly, the boom cylinder 8 contracts to cause the boom 5 to descend. In this case, because the boom 5 descends by the weight of the front attachment 4, pressurized oil may be supplied into the rod side oil chamber 8*b* to such an extent that the rod side oil chamber 8*b* is not made into vacuum, wherein only the recycling oil from the head side oil chamber 8*a* may be sufficient. In addition, surplus oil, obtained by subtracting the amount of oil supplied into the rod side oil chamber 8*b*, from the oil discharged from the head side oil chamber 8*a*, will be discharged into the oil reservoir 13 via the second boom control valve 15. Also, a part of the above-described recycling oil is prevented from flowing into the oil reservoir 13 via the reservoir line F by the make-up check valve 26.

To the contrary, where the boom 5 is caused to descend in a state where a force against the descent of the boom operates to carry out surface compaction work and scraping work of an inclined plane by the descending of the boom, because the pressure P of the rod side line B becomes greater than the predetermined pressure Pd ($P>Pd$), no command for magnetization of the solenoid 22*a* is outputted from the controller 24, and the change valve 22 is located at the first position X.

In a state where the above-described change 22 is located at the first position X, the pilot pressure outputted from the descending side pilot valve 19B, on the basis of operation of the boom operating lever 20, is supplied into the descending side pilot port 14*b* of the first boom control valve 14 via the change valve 22 located at the above-described first position X, and the first boom control valve 14 is changed to the descending side position Y, no pilot pressure is supplied into the descending side pilot port 15*b* of the second boom control valve 15, wherein the second boom control valve 15 is held in the neutral position N.

Further, the pilot pressure outputted from the descending side pilot valve 19B on the basis of operation of the boom operating lever 20 is supplied into the pilot port 21*a* of the opening and closing valve 21, and changes the opening and closing valve 21 to the second position Y that opens the communication line E. Also, as described above, the pilot operating check valve 23 is placed into a unidirectional state by commands from the controller 24.

Thereby, while the pressurized oil from the first pressurized oil supply source 11 is supplied into the rod side oil chamber 8*b* of the boom cylinder 8 via the first boom control valve 14, which is located at the above-described descending side position Y, and the rod side line B, oil discharged from the head side oil chamber 8*a* is supplied, as recycling oil, into the rod side oil chamber 8*b* via the head side line A, the communication line E and the rod side line B and, at the same time, surplus oil, which is obtained by subtracting the amount of oil supplied into the corresponding rod side oil chamber 8*b*, is discharged to the oil reservoir 13 via the first boom control valve 14 located at the above-described descending side position Y. In this regard, the boom cylinder 8 contracts to cause the boom 5 to descend.

On the other hand, where debris rake-up work and bumping work are carried out with the bottom of the bucket 7 grounded, the operation switch 27 is turned on. With the operation switch 27 turned on, commands of an external signal output are outputted from the controller 24 to the external signal outputting means 25, whereby the pilot operating check valve 23 is placed into a bi-directional state where oil flows in both directions, i.e., from the head side line A to the rod side line B and from the rod side line B to the head side line A.

Herein, as described above, even if the operation switch 27 is turned on where the pressure P of the rod side line B, which is detected by the first pressure sensor 28, is greater than the predetermined pressure Pd (that is, P>Pd), no command of an external signal output is outputted. That is, the pilot operating check valve 23 is placed into a bi-directional state only when the pressure P of the rod side line B is lower than or equal to the predetermined pressure Pd (that is, P≦Pd).

In this state, when the boom operating lever 20 is operated to the descending side, the output of the pilot pressure from the descending side pilot valve 19B is detected by the second pressure sensor 29, and at the same time, because the pressure P of the rod side line B, which is detected by the first pressure sensor 28, is lower than or equal to the predetermined pressure Pd (that is, P≦Pd), commands for magnetization of the solenoid 22*a* are outputted from the controller 24, and the change valve 22 is changed to the second position Y.

And, in a state where the above-described change valve 22 is located at the second position Y, the pilot pressure outputted from the descending side pilot valve 19B on the basis of operation of the boom operating lever 20 is supplied into the descending side pilot port 15*b* of the second boom control valve 15 via the change valve 22 located at the above-described second position Y, the second boom control valve 15 is changed to the descending side position Y, and no pilot pressure is supplied into the descending side pilot port 14*b* of the first boom control valve 14, wherein the first boom control valve 14 is held in the neutral position N, and no pressurized oil is supplied to the boom cylinder 8 or discharged therefrom.

Further, the opening and closing valve 21 is changed to the second position Y, that opens the communication line E, because the pilot pressure outputted from the descending side pilot valve 19B is supplied into the pilot port 21*a*. Also, as described above, the pilot operating check valve 23 is placed into a bi-directional state by commands from the controller 24.

Thereby, the head side oil chamber 8*a* of the boom cylinder 8 is caused to communicate with the rod side oil chamber 8*b* via the communication line E, wherein oil freely circulates between the oil chambers 8*a*, 8*b*, and a part of the oil discharged from both of the oil chambers 8*a*, 8*b* is caused to flow into the oil reservoir 13 via the second boom control valve 15 located at the above-described descending side position Y. In this state, the boom cylinder 8 automatically extends and contracts in response to an external force in the extension and contraction directions. Therefore, the boom 5 is caused to descend by the weight of the front attachment 4 until the bucket 7 is grounded to regulate its downward motion. On the other hand, the boom 5 is elevated when an upward reaction force operates from the ground surface.

In addition, where, when the boom cylinder 8 extends, oil that is supplied from the head side line A to the rod side line B via the communication line E temporarily becomes short and the rod side starts to become a vacuum, oil of the oil reservoir 13 is supplied through the reservoir line F via the make-up check valve 26, wherein it is possible to prevent the rod side from becoming a vacuum.

As such, in the present embodiment, where the boom 5 is caused to descend in the air, the first boom control valve 14 is held in the neutral position N, and the second boom control valve 15 is located at the descending side position Y, wherein while no pressurized oil from the first and second pressurized oil supply sources 11, 12 is supplied into the boom cylinder 8, and recycling oil is supplied solely from the head side oil chamber 8*a* into the rod side oil chamber 8*b* of the boom cylinder 8, surplus oil discharged from the head side oil chamber 8*a* is discharged into the oil reservoir 13 via the second boom control valve 15. As a result, in cases of operating the arm 6 and bucket 7 while causing the boom 5 to descend in the air, the entire amount of oil of the first and second pressurized oil supply sources 11, 12 is supplied into the arm cylinder 9 and bucket cylinder 10, wherein the motion speed of the arm 6 and bucket 7 becomes fast, thus improving work efficiency. In addition, where the boom 5 is caused to descend in the air independently, it is possible to eliminate energy loss by which unnecessary pressurized oil from the first and second pressurized oil supply sources 11, 12 is supplied into the boom cylinder 8, and this contributes to an improvement in fuel efficiency. In this case, the first boom control valve 14 located in the above-described neutral position N and the second control valve 15 located at the descending side position Y open the center bypass valve lines 14*c*, 15*c*. Therefore, if a variable control pump that is controlled so that the pump flow amount is decreased when the oil volume of the center bypass oil line is large is employed as the first or second pressurized oil supply sources 11, 12, further improvement in fuel efficiency can be achieved.

To the contrary, where the boom 5 is caused to descend to carry out surface compaction work and scraping work of an inclined plane by the descent of the boom, the first boom control valve 14 is changed to the descending side position Y, and the second boom control valve 15 is held in the neutral position, wherein recycling oil from the head side oil chamber 8*a* and pressurized oil from the first pressurized oil supply source 11 are supplied into the rod side oil chamber 8*b* of the boom cylinder 8 while the pressure of the rod side oil chamber 8*b* is lower than that of the head side oil chamber 8*a*. Also, after the pressure of the rod side oil chamber 8*b* becomes higher than the pressure of the head side oil chamber 8*a*, pressurized oil from the first pressurized oil supply source 11 is supplied therein although the supply of the recycling oil is blocked by the pilot operating check valve 23, wherein it is possible to carry out a descending motion of the boom 5 in a state where a force against the descent operates.

Further, where debris rake-up work or bumping work is carried out with the bottom of the bucket 7 grounded, when the operation switch 27 is turned on and the boom operating lever 20 is operated to the boom descending side, the first boom control valve 14 is held in the neutral position N, and the second boom control valve 15 is changed to the descending side position Y. At the same time, the head side oil chamber 8*a* of the boom cylinder 8 is caused to communicate with the rod side oil chamber 8*b* via the communication line E. And, for example, where debris rake-up work is carried out, if an arm drawing operation (extension of the arm cylinder 9) and a bucket opening operation (contraction of the bucket cylinder 10) are carried out with the boom operating lever 20 operated to the descending side (the amount of operation may be sufficient), the boom 5 is automatically elevated due to a reaction force from the ground while the boom 5 is automatically caused to descend by the weight of the front attachment 4, wherein it is possible to cause the bucket 7 to move along the ground surface without delicate operation of the boom 5, and work efficiency and operationality can be improved. In addition, where bumping work is carried out, if the boom operating lever 20 is operated to the descending side, the boom 5 descends due to the weight of the front attachment 4 until the bucket 7 is grounded, and the boom stops when the bucket 7 is grounded to regulate further descending motion. Therefore, even if the timing of raising the boom 5 is out of alignment, it is possible to eliminate an inconvenience by which the machine is raised by a reaction force caused when causing the boom 5 to descend, wherein work efficiency and operationality can be further improved.

Herein, as described above, where the pressure P of the rod side line B, which is detected by the first pressure sensor 28, is greater than the predetermined pressure Pd (that is, P>Pd), the pilot operating check valve 23 is set, so that it is not placed into a bi-directional state, even if the operation switch 27 is turned on. For example, when an operator erroneously turns on the operation switch 27 and operates to descend the boom to further raise the machinery body in a state where the front part of the machinery body is raised by grounding the bucket 7 by causing the boom to descend, pressing the ground and lifting the front part of the machinery body (in this state, where the pressure of the rod side line B is greater than the predetermined pressure Pd (P>Pd)) and if the pilot operating check valve 23 is in a bi-directional state, oil in the rod side line B will flow into the head side line A via the pilot operating check valve 23 located in a bi-directional state and, as a result of extension of the boom cylinder 8, the front part of the machinery body will fall to the ground. Then, the above-mentioned setting of the pilot operating check valve 23 prevents oil in the rod side line B from flowing into the head side line A resulting in the extension of the boom cylinder 8, and then prevents the front part of the machinery body from falling to the ground.

In this connection, it becomes possible to carry out a descending motion of the boom 5, which is suitable for respective work, on the basis of the changeover of ON and OFF of the operation switch 27 and the detection of the pressure of the rod side line B. Further, with this type of circuit, although oil discharge from the head side oil chamber 8*a* into the oil reservoir 13 is carried out by using the second boom control valve 15 when causing the boom 5 to descend with the first boom control valve 14 located in the neutral position N, when causing the boom 5 to elevate, the second boom control valve 15 is necessary in a general circuit in order to supply pressurized oil into the head side oil chamber 8*a* of the boom cylinder, and the type circuit is structured so that oil discharge is carried out by using the second boom control valve 15. Therefore, because it is not necessary to provide an exclusive discharge valve and an exclusive discharge line, the production costs are reduced.

In summary, the hydraulic control circuit for a boom cylinder according to the invention has a first control valve that is freely changed to an operation position that controls the supply of pressurized oil to the boom cylinder and the discharge thereof on the basis of operations of an operating member with the first pressurized oil supply source used as a pressurized supply source and to a neutral position where no pressurized oil is supplied thereinto and discharged therefrom; and the second control valve that controls supply of pressurized oil to the weight-holding side oil chamber of the boom cylinder, with a second pressurized oil supply source used as another pressurized oil supply source, wherein the corresponding hydraulic control circuit is provided with neutral holding means capable of holding the first control valve at the neutral position regardless of any operation of the operating member and a communication line for causing both of the oil chambers of the boom cylinder to communicate with each other, the corresponding communication line is provided with opening and closing valve means for opening and closing the communication line, and a direction valve means that is freely changed to an unidirectional state where, while an oil flow from the weight-holding side oil chamber of the boom cylinder to the other oil chamber is permitted, a reverse oil flow is hindered, and a bi-directional state is permitted where oil flows in both directions; and the above-described second control valve is provided with discharge means for flowing surplus oil, which is discharged from the weight-holding side oil chamber of the boom cylinder and supplied into the other oil chamber, into an oil reservoir when the first control valve is held in the neutral position by the neutral holding means. As a result, because the first control valve is held in the neutral position, and the communication line is opened or closed in an unidirectional or bi-directional state, this contributes to improvement in fuel efficiency. At the same time, it is possible to improve work efficiency in combination work or to improve work efficiency and operationality in work requiring difficult operation of the boom, such as debris rake-up work and bumping work. Still further, as oil can be discharged from the weight-holding side oil chamber with the first control valve held in the neutral position by using the second control valve, it is not necessary to additionally provide an exclusive discharge valve and an exclusive discharge line, whereby production costs can be further reduced.

The invention is not limited to the above-described embodiment. Not only are the arm cylinder and bucket cylinder acceptable but also a hydraulic actuator, such as a traveling motor, swivel motor, etc., may be acceptable as the hydraulic actuator whose pressurized oil supply source is concurrently used for the boom cylinder. In the cases of such hydraulic actuators, an operation speed interlocked with the descent of the boom in the air can be made faster. In addition, a connection between a control valve for the hydraulic actuators and a control valve for boom control may be in series or parallel, and in either case, similar effects can be achieved.

What is claimed is:

1. A hydraulic control circuit for a boom cylinder in a work machine, comprising:

a boom cylinder that causes the boom to extend and contract in order to move the boom upward and downward;

a first control valve that is freely changed to an operation position that controls supply of pressurized oil to respective oil chambers at a head side and a rod side of the boom cylinder and discharge thereof on the basis of operations of an operating member with a first pressurized oil supply source used as a pressurized supply source and to a neutral position where no pressurized oil is supplied thereinto and discharged therefrom; and a second control valve that controls supply of pressurized oil to a weight-holding side oil chamber of the respective oil chambers of the boom cylinder, which holds the weight of the boom, with a second pressurized oil supply source used as another pressurized oil supply source, wherein the hydraulic control circuit is provided with neutral holding means capable of holding the first control valve at the neutral position regardless of any operation of the operating member and a communication line for causing the head side oil chamber and the rod side oil chamber of the boom cylinder to communicate with each other, the communication line is provided with an opening and closing valve that opens and closes the communication line, and a direction valve that is freely changed to a unidirectional state where, while an oil flow from the weight-holding side oil chamber of the boom cylinder to the other oil chamber is permitted, a reverse oil flow is hindered, and to a bi-directional state where both oil flows are permitted, and the second control valve is provided with discharge means for flowing surplus oil, which is discharged from the weight-holding side oil chamber of the boom cylinder and supplied into the other oil chamber, into an oil reservoir when the first control valve is held in the neutral position of the first control valve by the neutral holding means.

2. The hydraulic control circuit for a boom cylinder in a work machine according to claim 1, wherein pressure detecting means that detects the pressure of the other oil chamber is provided, and when the pressure of the other oil chamber, which is detected by the pressure detecting means, is lower than or equal to a predetermined pressure, the neutral holding means operates so that the first control valve is held in the neutral position.

3. The hydraulic control circuit for a boom cylinder in a work machine according to claim 1, wherein the neutral holding means comprises a change valve that can interrupt pilot pressure outputted so as to change the first control valve to the operation position on the basis of operations of the operating member.

4. The hydraulic control circuit for a boom cylinder in a work machine according to claim 3, wherein, while the change valve constituting the neutral holding means interrupts output of pilot pressure to the first control valve, the change valve outputs the pilot pressure to the second control valve to change it into an operation state of the discharge means.

5. The hydraulic control circuit for a boom cylinder in a work machine according to claim 1, wherein pressure detecting means that detects the pressure of the other oil chamber is provided, and when the pressure of the other oil chamber, which is detected by the pressure detecting means, exceeds a predetermined pressure, the direction valve is set so that an unidirectional state is not changed to a bi-directional state.

6. The hydraulic control circuit for a boom cylinder for a work machine according to claim 2, wherein the neutral holding means comprises a change valve that can interrupt pilot pressure outputted so as to change the first control valve to the operation position on the basis of operations of the operating member.

7. The hydraulic control circuit for a boom cylinder for a work machine according to claim 6, wherein, while the change valve constituting the neutral holding means interrupts output of pilot pressure to the first control valve, the change valve outputs the pilot pressure to the second control valve to change it into an operation state of the discharge means.

8. The hydraulic control circuit for a boom cylinder in a work machine according to claim 2, wherein when the pressure of the other oil chamber, which is detected by the pressure detecting means, exceeds the predetermined pressure, the direction valve is set so that an unidirectional state is not changed to a bi-directional state.

9. The hydraulic control circuit for a boom cylinder in a work machine according to claim 3, wherein pressure detecting means that detects the pressure of the other oil chamber is provided, and when the pressure of the other oil chamber, which is detected by the pressure detecting means, exceeds a predetermined pressure, the direction valve is set so that an unidirectional state is not changed to a bi-directional state.

10. The hydraulic control circuit for a boom cylinder in a work machine according to claim 4, wherein pressure detecting means that detects the pressure of the other oil chamber is provided, and when the pressure of the other oil chamber, which is detected by the pressure detecting means, exceeds a predetermined pressure, the direction valve is set so that an unidirectional state is not changed to a bi-directional state.

11. The hydraulic control circuit for a boom cylinder in a work machine according to claim 6, wherein when the pressure of the other oil chamber, which is detected by the pressure detecting means, exceeds the predetermined pressure, the direction valve is set so that an unidirectional state is not changed to a bi-directional state.

12. The hydraulic control circuit for a boom cylinder in a work machine according to claim 7, wherein when the pressure of the other oil chamber, which is detected by the pressure detecting means, exceeds the predetermined pressure, the direction valve is set so that an unidirectional state is not changed to a bi-directional state.

* * * * *